US007921818B2

(12) United States Patent
Rauch et al.

(10) Patent No.: US 7,921,818 B2
(45) Date of Patent: Apr. 12, 2011

(54) VALVE CONTROL FOR RECIPROCATING PISTON INTERNAL COMBUSTION ENGINE

(75) Inventors: Martin Rauch, Bamberg (DE); Thomas Kremer, Furth (DE); Nicola Morelli, Herzogenaurach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 315 days.

(21) Appl. No.: 12/205,960

(22) Filed: Sep. 8, 2008

(65) Prior Publication Data

US 2009/0064955 A1 Mar. 12, 2009

(30) Foreign Application Priority Data

Sep. 8, 2007 (DE) ..... 10 2007 042 893

(51) Int. Cl.
*F01L 9/02* (2006.01)

(52) U.S. Cl. ..... 123/90.12; 123/90.5; 123/90.16

(58) Field of Classification Search ..... 123/90.12, 123/90.16, 90.5, 90.39
See application file for complete search history.

(56) References Cited

U.S. PATENT DOCUMENTS

| | | | | |
|---|---|---|---|---|
| 3,963,004 | A * | 6/1976 | Lysinger et al. | 123/90.4 |
| 5,778,842 | A * | 7/1998 | Schmidt et al. | 123/90.39 |
| 6,883,492 | B2 | 4/2005 | Vanderpoel et al. | |
| 2006/0000432 | A1 | 1/2006 | Yamamoto et al. | |

* cited by examiner

*Primary Examiner* — Zelalem Eshete
(74) *Attorney, Agent, or Firm* — Volpe and Koenig, P.C.

(57) ABSTRACT

Valve controller for reciprocating piston internal combustion engines with at least two intake and/or exhaust gas-exchange valves for each piston/cylinder unit, wherein the gas-exchange valves are guided by valve stems in a cylinder head (8) of the reciprocating piston internal combustion engine, loaded in a closing direction by valve springs, and can be controlled via a common bridge (10) by an activation device, wherein the bridge (10) is guided over a sliding surface parallel to the movement of the gas-exchange valves, the bridge (10) has at least one hydraulic valve clearance compensation element (14 or 15) that connects to a gas-exchange valve, and a device is provided that prevents rotation of the bridge (10) about the sliding surface.

9 Claims, 3 Drawing Sheets

VALVE CONTROL FOR RECIPROCATING PISTON INTERNAL COMBUSTION ENGINE

BACKGROUND

A valve controller is disclosed for reciprocating piston internal combustion engines with at least two intake and/or exhaust gas-exchange valves for each piston/cylinder unit, wherein these gas-exchange valves are guided by valve stems in a cylinder head of the reciprocating piston internal combustion engine and are loaded in the closing direction by valve springs and can be controlled via a common bridge through the use of an activation device.

A class-defining valve controller of this type is known from U.S. Pat. No. 6,883,492 B2. This valve controller has a bridge that is guided over both valve stem ends in such a way that recesses are provided in the bridge, wherein the valve stem ends project into these recesses. The bridge is controlled by a master piston of a hydraulic activation unit, wherein the master piston includes a hydraulic valve clearance compensation element. This hydraulic valve clearance compensation element is in no way sufficient to guarantee equal movement of the gas-exchange valves both in the closed position and also in the open position, because the valves are guided more or less rigidly by the bridge and recesses in the bridge that enclose the valve stems (see FIG. 2). A risk, in particular, is that the gas-exchange valves will not close cleanly at the same time.

Furthermore, a valve controller for reciprocating piston internal combustion engines is known from US 2006/0432 A1, that also has a bridge containing recesses for the valve stems and furthermore a sliding surface that encloses a guide rod attached to the cylinder head. This patent application explicitly involves a closing body that is inserted into the bridge and that is in active connection with a valve lifter of an activation device. This valve lifter is driven conventionally via a tappet push rod and a cam follower by a cam of a camshaft. This activation of the gas-exchange valves is also not satisfied when the bridge is guided, because the gas-exchange valves are forcibly guided, so that there is also the risk that they do not close exactly and equally.

SUMMARY

Therefore, the object of the invention is to improve a valve controller for reciprocating piston internal combustion engines according to the class-forming state of the art to the extent that an exact guidance of the gas-exchange valves is guaranteed, wherein tolerances and differences in length of the valve stems are also taken into account and these are eliminated in this way.

The objective of the invention is met in that the bridge is guided by a sliding guide parallel to the movement of the gas-exchange valves, the bridge has at least one hydraulic valve clearance compensation element (HVA) that is in active connection with a gas-exchange valve, and a device is provided that prevents rotation of the bridge about the sliding guide. Through this construction, it is initially achieved that the bridge has an exact guide, and furthermore each gas-exchange valve or each valve stem can move freely and the gas-exchange valves can close cleanly.

If an adjustment screw for this gas-exchange valve is provided on the end of the bridge opposite the hydraulic valve clearance compensation element, then the hydraulic valve clearance compensation element in the activation device or in the master piston is unnecessary.

However, a hydraulic valve clearance compensation element, as claimed, can also be present in the bridge and another in the activation device or the master piston.

It is furthermore also possible to install two hydraulic valve clearance compensation elements in the bridge, wherein each is provided for one gas-exchange valve. Then a hydraulic valve clearance compensation element in the activation device or in the master piston is unnecessary.

In one advantageous construction, it is provided that a guide rod is attached to the cylinder head. On this guide rod, the bridge is guided over a sliding surface that is advantageously arranged in the middle on the line connecting the gas-exchange valves.

It is also possible and therefore alternatively proposed that a guide surface is provided on the cylinder head. This guide surface is engaged by a shaft of the bridge as a sliding guide and is advantageously arranged, in turn, in the middle between the valve shafts.

In this way it is achieved that the bridge is either guided by the sliding surface constructed as a sliding cylinder on the guide rod or via the shaft of the bridge being guided in a sliding cylinder opening as a guide surface in the cylinder head.

Advantageously, the device against rotation has a second rod attached to the cylinder head or a second guide surface on which the bridge is guided by another sliding surface or another shaft.

These embodiments involve exact guides for the bridge against rotation that, however, produce a certain structural expense.

It is also naturally possible to provide on the bridge a recess that partially surrounds the valve shaft laterally.

An alternative embodiment provides a simple solution in which the component of the hydraulic valve clearance compensation element in active connection with the valve shaft has an opening that surrounds the valve shaft. This solution is certainly very favorable, because such a recess can be taken into account directly in the production of the hydraulic valve clearance compensation element.

In order to prevent pumping of the bridge onto the guide rod or into the guide surface in the cylinder head, it is proposed that an opening is provided through which oil, air, and the like can escape at the end of the sliding surface or the guide surface.

In order to guarantee, in a simple way, a supply of oil to the hydraulic valve clearance compensation element or elements, it is proposed that the guide rod or the shaft have a supply line that is attached to the oil circuit of the reciprocating internal combustion engine and can be connected to at least one channel in the bridge that leads to the hydraulic valve clearance compensation element. Here, advantageously, the guide rod or the shaft or the end or ends of the channel have openings that extend into the bridge and that are adapted to the stroke of the gas-exchange valves, so that the supply of oil to the HVA element is guaranteed in all of the positions.

If the bridge, as proposed, is made from lightweight material, in particular, lightweight metal and optionally has other material recesses or material openings, then the moving mass of the bridge can be reduced to a minimum.

An especially favorable and flexible valve controller is given when the activation device is constructed as a hydraulic unit with at least one pumping piston that is in active connection with at least one cam of a camshaft driven by the reciprocating piston internal combustion engine, with at least one master piston that is guided in a housing and that is connected with a convex master surface to the bridge, and with an electrically/electronically activated control device that causes the inflow and outflow of hydraulic medium at least to the master piston (pistons). In this way a variable valve controller is achieved in which both the lift curves and also the opening times can be varied essentially arbitrarily.

The bridge advantageously has a tappet that is in active connection with the master piston. The tappet can here be constructed as a sliding guide for the bridge that is guided advantageously in the cylinder of the master piston on the housing. For this purpose, the cylinder or the housing could be lengthened in the direction of the bridge, so that a good guide is given.

BRIEF DESCRIPTION OF THE DRAWINGS

For further explanation of the invention, reference is made to the drawings in which an embodiment of the invention is shown simplified. Shown are.

DETAILED DESCRIPTION OF THE PREFERRED EMBODIMENTS

Figure 1:
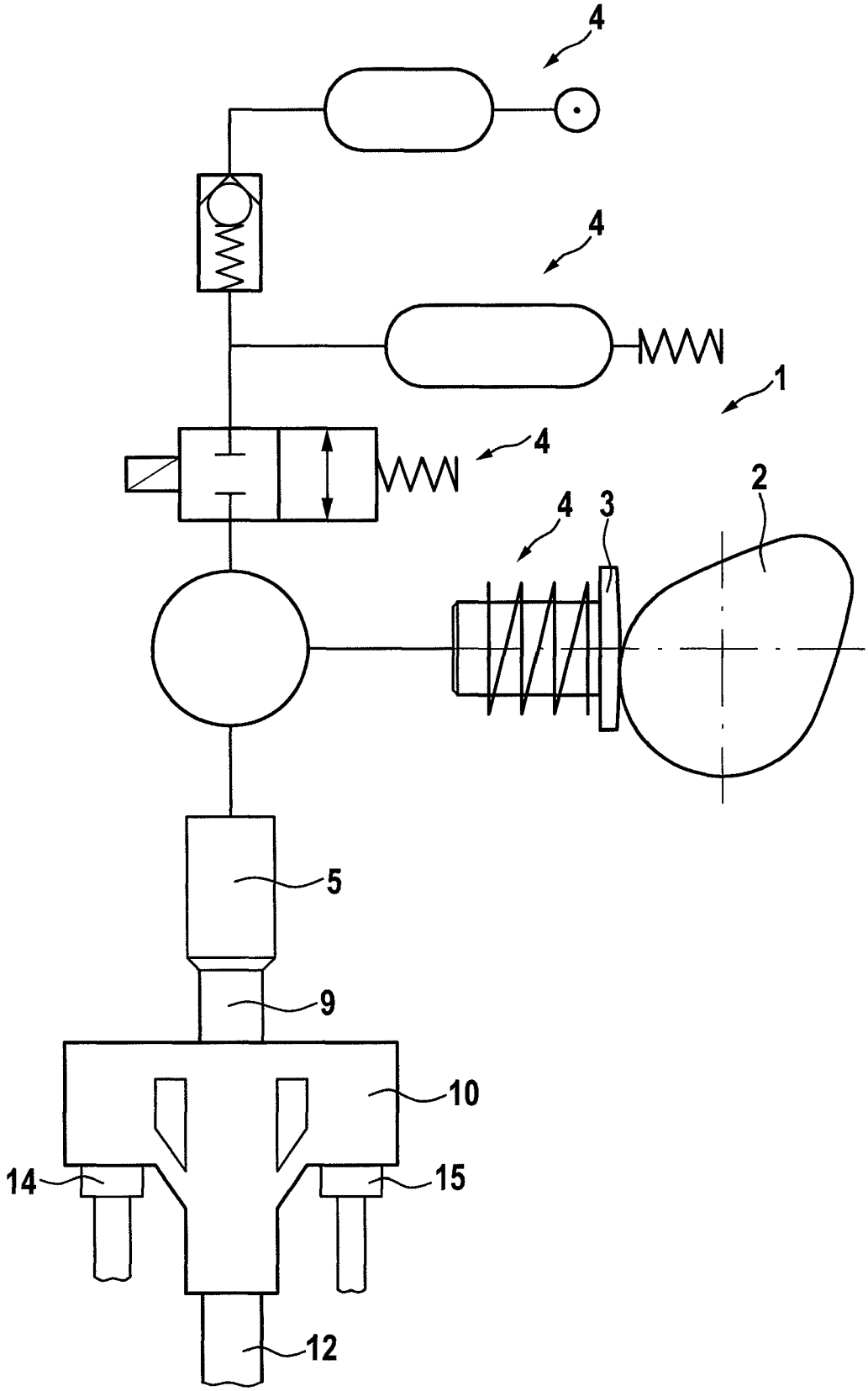
FIG. 1: a schematic view of a valve controller with an activation device forming a hydraulic unit and with a bridge.

In FIGS. 1 to 4, as far as shown in detail, a hydraulic unit is designated in general with 1 as an activation device for the gas-exchange valves and has a cam 2, a pumping piston 3, a control device 4 with various elements, and a master piston 5. The master piston 5 is supported in a housing 7 with an intermediate connection of a bushing 6, as shown, in particular, in FIG. 4. The housing 7, not shown in more detail, is attached to a cylinder head 8 that is similarly partially shown in FIG. 4. A tappet 9 that is attached to a bridge 10 connects to the master piston 5 (see FIGS. 1 and 4). The master piston 5 has a convex construction on the surface facing the tappet 9, so that alignment deviations can be compensated.

Figure 3:
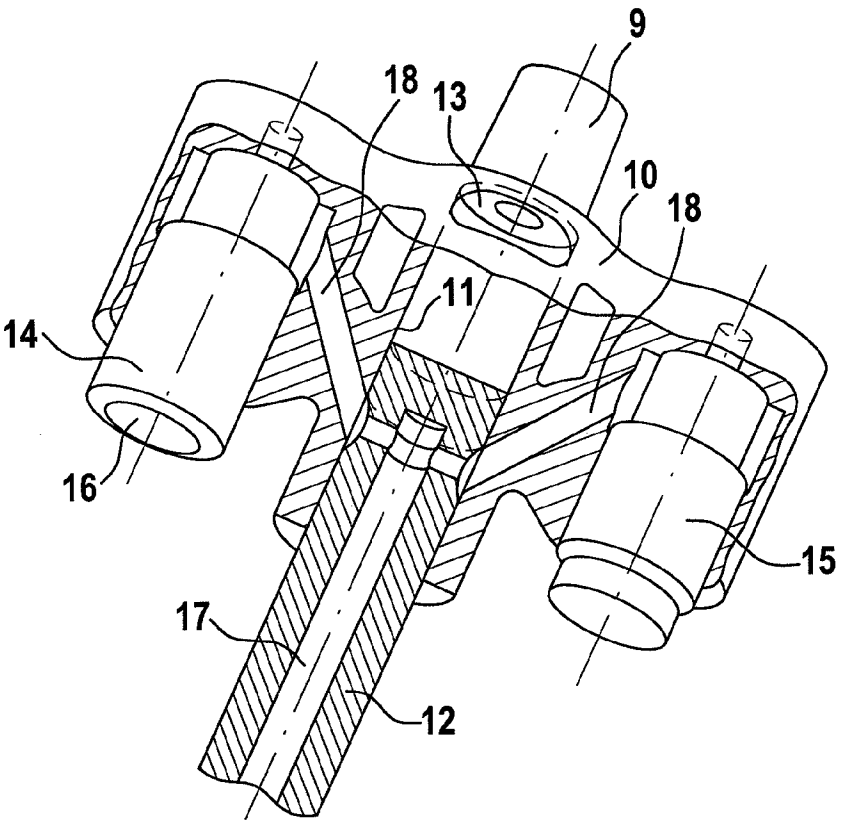
FIG. 3: a perspective view of a bridge with section through a guide rod.
Figure 2:
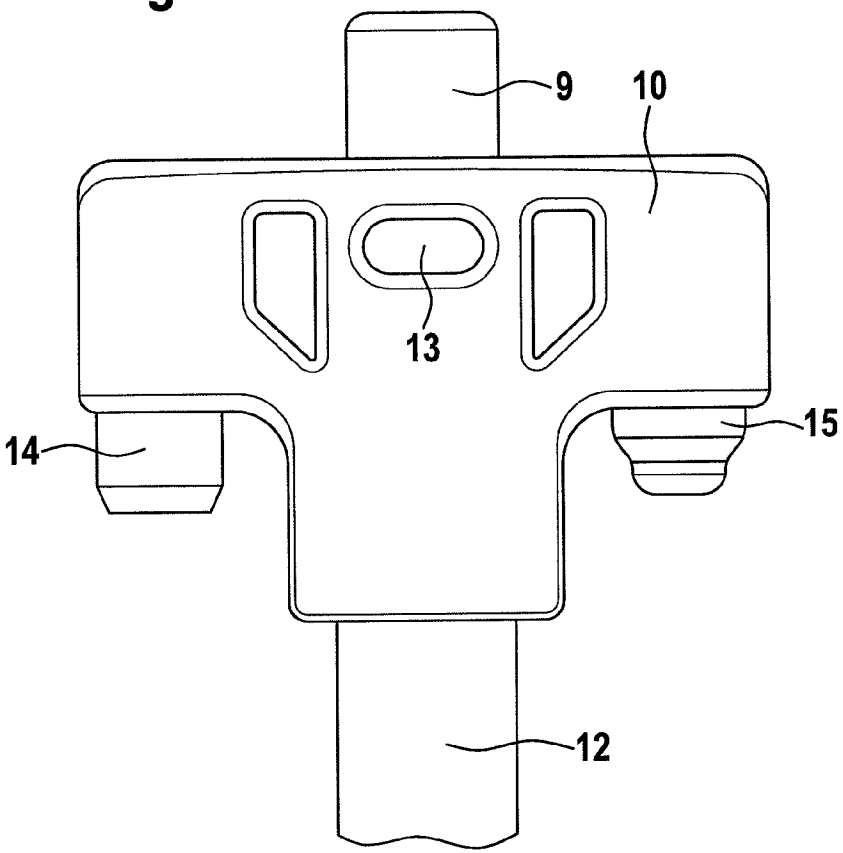
FIG. 2: a side view of a bridge.
Figure 4:
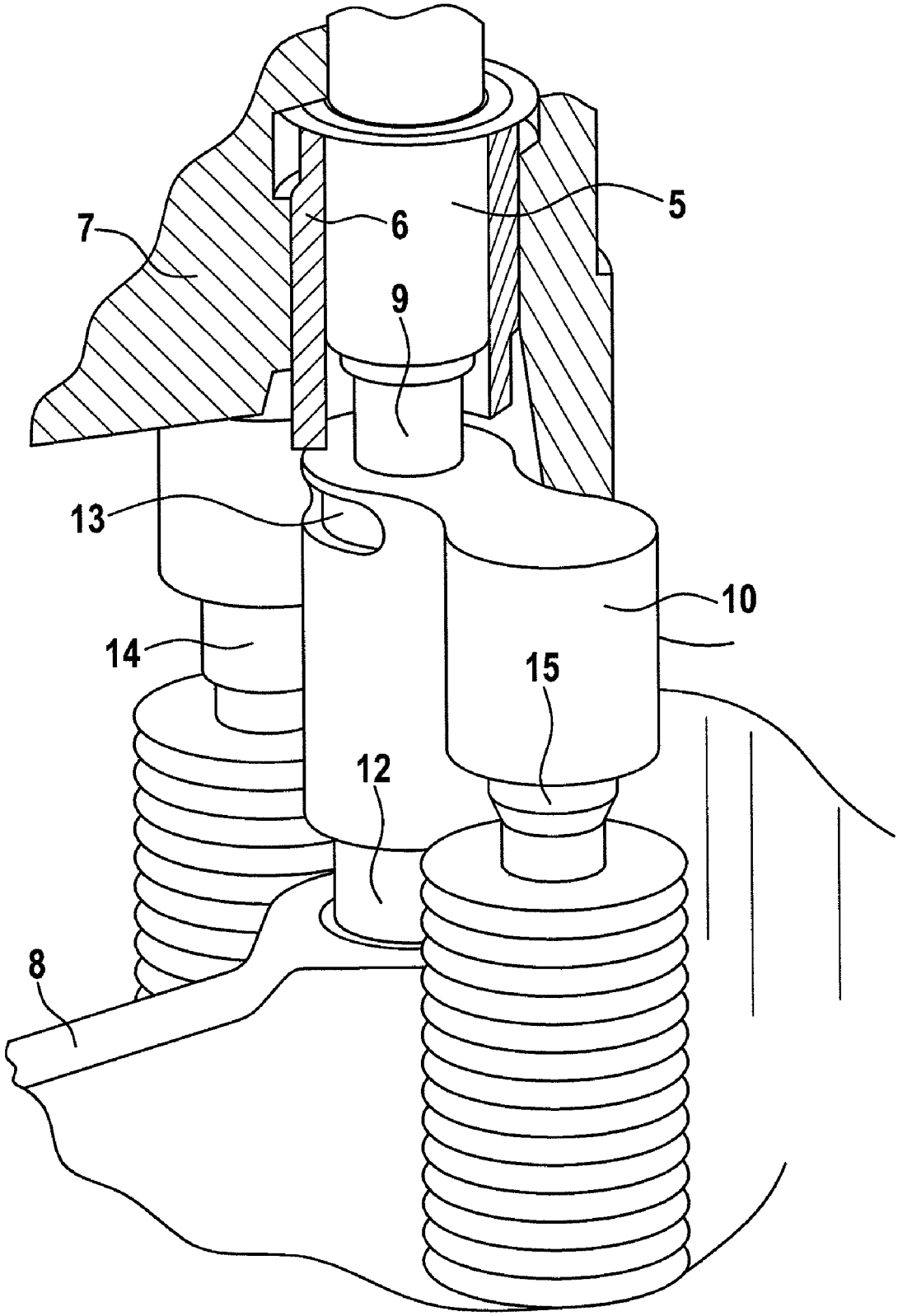
FIG. 4: a partial view of a cylinder head with gas-exchange valves, a bridge, and a housing with master piston.

The bridge 10 advantageously has a T-shaped construction and has a sliding surface 11 that is constructed as a circular cylinder and encloses a guide rod 12 that is not shown in more detail and that is attached to the cylinder head 8. For reducing weight, the bridge 10 has material openings that are shown in FIGS. 1 to 3. Furthermore, at the end of the sliding surface 11 there is an opening designated with 13 so that the bridge 10 can slide freely on the guide rod 12, without pressure from oil and/or air being able to build up. In the bridge 10, hydraulic valve clearance compensation elements 14 and 15 are installed which engage the gas-exchange valves. These compensation elements have a known configuration and have been produced in large quantities by the applicant for a long time. The hydraulic valve clearance compensation element 14 differs from that designated with 15 in that the end piece has a recess 16 that can enclose a valve stem of a gas-exchange valve and thus ensures rotational locking of the bridge about the guide rod 12.

As shown in FIG. 3, a supply line that is not shown in more detail and that is connected to the oil circuit of the reciprocating piston internal combustion engine is provided in the guide rod 12. The supply line has at least one transverse borehole that is provided with longitudinal openings connecting to channels designated with 18 in the bridge 10 and leading to the hydraulic valve clearance compensation elements 14 and 15 and supplying these elements with pressurized hydraulic fluid.

LIST OF REFERENCE SYMBOLS

1 Hydraulic unit
2 Cam
3 Pumping piston
4 Control device
5 Master piston
6 Bushing
7 Housing
8 Cylinder head
9 Tappet
10 Bridge
11 Sliding surface
12 Guide rod
13 Opening
14 Hydraulic valve clearance compensation element
15 Hydraulic valve clearance compensation element
16 Recess
17 Supply line
18 Channels

The invention claimed is:

1. Valve controller for reciprocating piston internal combustion engines with at least two intake or exhaust gas-exchange valves for each piston/cylinder unit, wherein the gas-exchange valves are guided by valve stems in a cylinder head of the reciprocating piston internal combustion engine, loaded in a closing direction by valve springs, a common bridge that controls the valves through the use of an activation device, the activation device is constructed as a hydraulic unit with at least one pumping piston that is in active connection with at least one cam of a camshaft driven by a reciprocating piston internal combustion engine, with at least one master piston that is guided in a housing and is connected with a convex master surface to the bridge, and with an electrically/electronically activated control device that directs an inflow and outflow of hydraulic medium at least to the master piston, the bridge is guided by a sliding guide parallel to a movement direction of the gas-exchange valves, the bridge has at least one hydraulic valve clearance compensation element that connects to a gas-exchange valve, and a device is provided that prevents rotation of the bridge about the sliding guide, and the bridge has a tappet that is in active connection with the master piston, and the tappet is constructed as the sliding guide for the bridge that is guided in the cylinder of the master piston on the housing.

2. Valve controller according to claim 1, wherein a guide rod is attached to the cylinder head on which the bridge is guided by a sliding surface.

3. Valve controller according to claim 1, wherein a guide surface is provided on the cylinder head, in which a shaft of the bridge engages as a sliding guide.

4. Valve controller according to claim 2, wherein the guide rod and the sliding surface and also the guide surface and the shaft are arranged essentially in a middle of a line between the gas-exchange valves.

5. Valve controller according to claim 1, wherein the device that prevents rotation includes a second rod attached to the cylinder head or a second guide surface on which the bridge is guided over another sliding surface or another shaft.

6. Valve controller according to claim 1, wherein the device that prevents rotation includes at least one guide surface on contact surface of at least one of the bridge or the hydraulic valve clearance compensation element that is in active connection with at least one valve stem.

7. Valve controller according to claim 2, wherein the sliding surface of the bridge or the guide surface on the cylinder head has a circular cylinder on whose end facing away from the guide rod or the shaft, an opening is provided.

8. Valve controller according to claim 2, wherein the guide rod has a supply line that is connected to the oil circuit of the reciprocating piston internal combustion engine and can be connected to at least one channel in the bridge that leads to the hydraulic valve clearance compensation element.

9. Valve controller according to claim 1, wherein the bridge is at least one of produced from a lightweight material or has material recesses or material openings.

* * * * *